US006375033B1

(12) United States Patent
Fleming

(10) Patent No.: US 6,375,033 B1
(45) **Date of Patent: *Apr. 23, 2002**

(54) VAPOR DIRECTOR BEVERAGE CONTAINER

(76) Inventor: Douglas H. Fleming, 4126 - Ashworth Ave. North, Seattle, WA (US) 98103

( * ) Notice: Subject to any disclaimer, the term of this patent is extended or adjusted under 35 U.S.C. 154(b) by 0 days.

This patent is subject to a terminal disclaimer.

(21) Appl. No.: 09/468,289

(22) Filed: Dec. 20, 1999

Related U.S. Application Data

(63) Continuation-in-part of application No. 08/730,483, filed on Oct. 11, 1996.

(51) Int. Cl.[7] ..... B65D 23/00

(52) U.S. Cl. ..... 220/713; 220/714; 220/719; 220/501; 220/367.1

(58) Field of Search ..... 220/719, 713, 220/714, 563, 501, 367.1

(56) References Cited

U.S. PATENT DOCUMENTS

| | | | | |
|---|---|---|---|---|
| 2,358,600 | A | 9/1944 | Selten | 65/13 |
| 2,362,354 | A | 11/1944 | Clovis | 65/13 |
| 3,360,161 | A | 12/1967 | Smith | 220/719 |
| 3,400,855 | A | 9/1968 | Alexander | 220/90.4 |
| 3,938,695 | A | 2/1976 | Ruff | 220/90.4 |
| 4,085,861 | A | 4/1978 | Ruff | 220/90.4 |
| 4,586,625 | A | 5/1986 | Garrett | 220/266 |
| 4,589,569 | A | 5/1986 | Clements | 220/380 |
| 4,609,124 | A | 9/1986 | Malloy | 220/260 |
| 4,619,372 | A | 10/1986 | McFarland | 220/90.4 |
| 4,768,674 | A | 9/1988 | Prescott | 220/90.4 |
| 4,938,377 | A | 7/1990 | Jarvis | 220/216 |
| 5,370,258 | A | 12/1994 | Fair | 220/719 |
| 5,540,350 | A | 7/1996 | Lansky | 220/380 |
| 5,542,670 | A | 8/1996 | Morano | 220/714 |

FOREIGN PATENT DOCUMENTS

| | | | |
|---|---|---|---|
| GB | 502009 | 3/1939 | 220/719 |

*Primary Examiner*—Joseph M. Moy
(74) *Attorney, Agent, or Firm*—R. Reams Goodloe, Jr.

(57) ABSTRACT

A vapor directing baffle for a beverage container. The combination of a beverage container and a tight fitting lid in combination with an internal baffle forces aroma laden vapor (located between the interior of the lid and the liquid surface of the beverage in the container) outward through openings in the lid, when the beverage container is tipped from the level position to the drinking position. This vapor pumping action places the outwardly flowing aroma beneath the nose of a user, thereby allowing the user to enjoy the aroma of the beverage.

51 Claims, 12 Drawing Sheets

VAPOR DIRECTOR BEVERAGE CONTAINER

This application is a 371 of C-I-P of Ser. No. 08/730,483 filed Oct. 11, 1996.

TECHNICAL FIELD

The present invention relates to beverage containers, and, more particularly, to a covered beverage container that directs vapor and aroma emanating from a beverage in a predetermined direction. Such containers are especially useful for serving coffee and tea.

BACKGROUND

It is well known that the aroma of a beverage comprises a large part of the flavor of the beverage. This is because while most human taste buds sense only sweet, salt, sour, and bitter tastes, the human nose can distinguish between approximately 10,000 distinct odors.

Presently, covered beverage containers typically prevent the consumer from enjoying, to a very significant degree, the aroma of the beverage when the beverage is consumed while the lid of the container remains in place. A few covered beverage containers of which I am aware allow for aroma laden air vapor to travel through drink openings or other small openings for venting air. However, because in typical containers the opening of the container must remain covered in order to achieve the benefits of a lid (such as reduced risk of spilling and retaining the heat of hot beverages), traditional lidded beverage containers have resulted in very little of available aromas actually reaching the nostrils of the drinker.

Thus, there remains an unmet need for an improved lid for beverage containers, and for containers which can be used in combination with such lids, that include structural features that would direct available aromas to the consumer, for increased enjoyment during consumption of flavorful beverages.

SUMMARY

I have now developed a vapor directing beverage container that includes a lid and a unique internal baffle. The lid has a drink opening to allow beverage to pass through the lid while the lid remains attached to the container. At least one vent opening, and preferably two or more vent openings (in addition to the drink opening) are provided to allow vapor within the container to pass through the lid. In one embodiment, the internal baffle is sized and shaped so that when it is inserted into the container, the baffle substantially seals against the container inner side walls, and the baffle extends down into the container so that the bottom of the baffle is very near to the bottom of the container. The space between the bottom of the baffle and the bottom of the container allows liquid in the container to flow freely from one side of the baffle to the other side of the baffle. The baffle sealably attaches to, or is integrally and sealingly provided with, the lid of the container. The baffle is positioned between the drink opening and one vent opening so as to divide the space within the container into at least two chambers. When the container is tipped to allow beverage to flow out of the drink opening, vapor within one chamber is forced out of at least one opening in the lid while air from outside the container is simultaneously drawn into the container through one or more openings on the other side of the baffle. The precise location, shape, and number of vent openings through which vapor is directed can vary depending upon the size and shape of the lid and of the container in order control the direction and speed of the vapor.

More generally, a covered beverage container is provided for pumping vapor from within the container to the vicinity of the user's nose when the container is tipped from a level, upright or generally vertical position to a more generally horizontal oriented drinking position, or when the container is returned from the drinking position back to a level, upright position.

In accordance with another aspect of the present invention, the beverage container includes a lid through which beverage can be drunk with the lid still in place, thereby reducing the amount of spillage from the container and retaining the heat of a hot beverage while the container remains at rest.

The method of the present invention utilizes a baffle that, when the container is tipped, allows the rising liquid level in one half of the container to force vapor out of one or more of the vapor openings in the lid, and then towards the user's nose. This method provides a unique mechanism, beyond mere volatilization, by which the aroma of the beverage can be enjoyed by the user.

The foregoing briefly described vapor directing beverage container structure, and my method of directing aromas to the consumer of a beverage, and the various objectives, features and advantages of the invention will be more readily understood upon consideration of the following detailed description, taken in conjunction with careful examination of the accompanying drawing.

BRIEF DESCRIPTION OF DRAWING

In the various figures of the drawing, like features may be illustrated with the same reference numerals, without further mention thereof.

DETAILED DESCRIPTION

Figure 1:
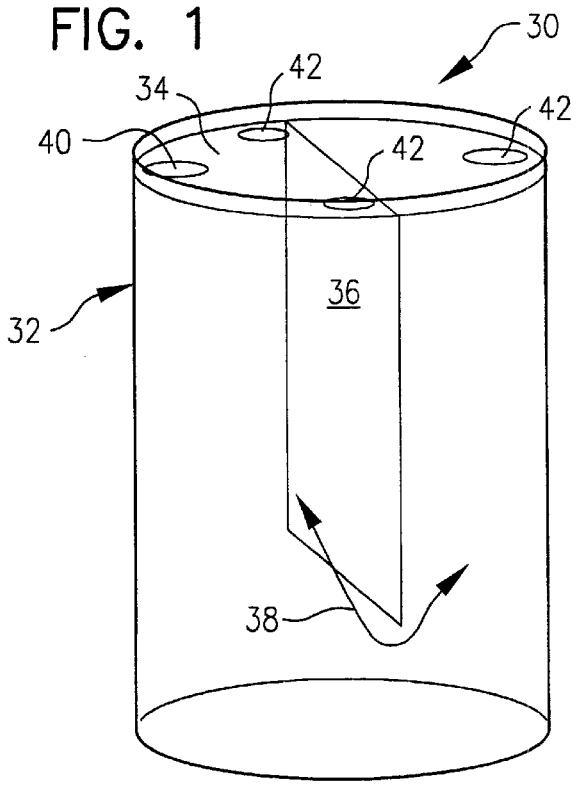
FIG. 1 shows the side view of a simple vapor directing beverage container with a vertical baffle provided roughly in the center of the container.
Figure 3:
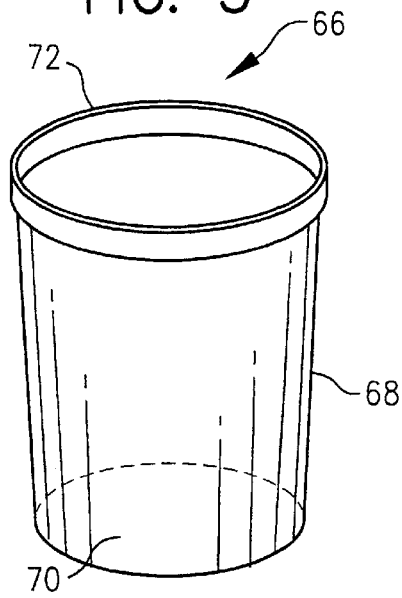
FIG. 3 shows a beverage container or cup.

Attention is directed to FIG. 1 of the drawing, which depicts a simple embodiment of my vapor directing beverage container 30. The vapor directing beverage container 30 includes a container 32 with a closure lid 34 sealed to the rim of the container 32. A baffle 36 seals against the lid 34 and the side walls of the container 32. A gap in 38 between the bottom of the container 32 and the bottom edge of the baffle 36 allows liquid in the container 32 to flow freely from one side of the baffle 36 to the other side. The lid 34 has a drink opening 40 and vent openings 42.

Figure 2:
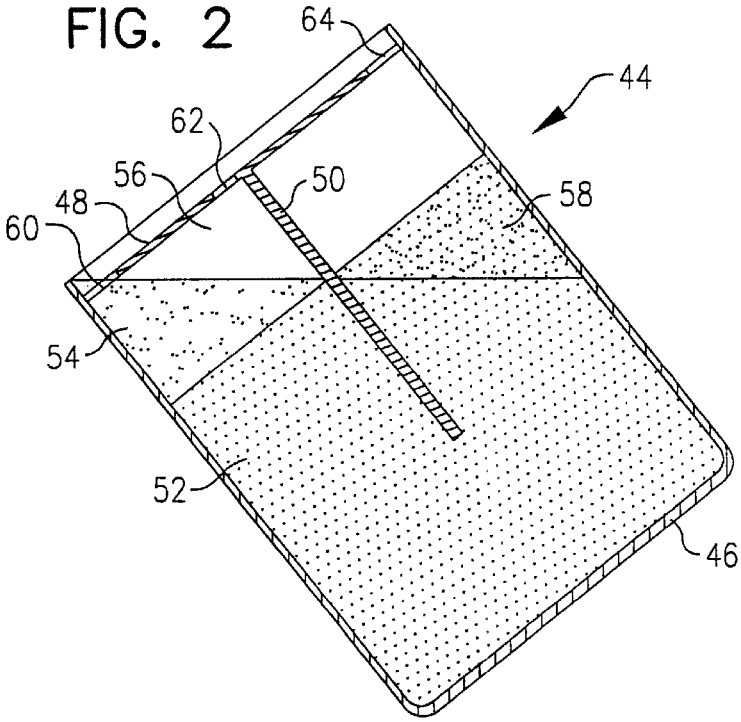
FIG. 2 shows a schematic of the method directing vapor to the nose of a user which can be achieved by tipping a vapor directing beverage container.

FIG. 2 shows a simplified two-dimensional schematic of the vapor directing beverage container 30, which is shown in FIG. 1, where the liquid in container 46 is represented by the shaded areas 52, 54, and 58. In a level position the same volume of liquid in the container 46 would occupy the shaded areas 52 and 58. As the container 46 is tipped from the level position to the drinking position, the air volume 56 decreases. The vapor previously occupying area 54 is forced out of the drink opening 60 and out of the vent opening 62. When the container is tipped back to the level position, the vapor in area 58 is forced out of the vent opening 64.

FIG. 3 through FIG. 7 depict one of the alternative embodiments of the present invention. The container 66 is any conventional configuration and construction including disposable cups of the type commonly used as carry out containers for beverages such as coffee and tea. Typically, the container 66 has downwardly converging side walls 68 and a bottom 70 so that the container 66 is an inverted frusto-conical shape. The container 66 may be fabricated from any number of materials including wax or resin impregnated paper, Styrofoam, plastic sheet or paperboard. The container typically has a bead formed on the rim 72 to facilitate attachment of a lid.

Figure 4:
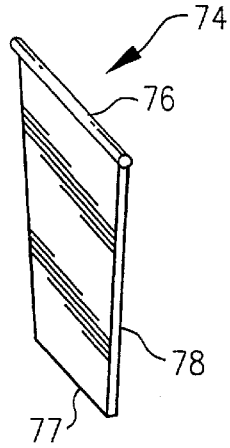
FIG. 4 shows one embodiment of a disposable baffle for use in conjunction with a disposable lid and a disposable cup.
Figure 5:
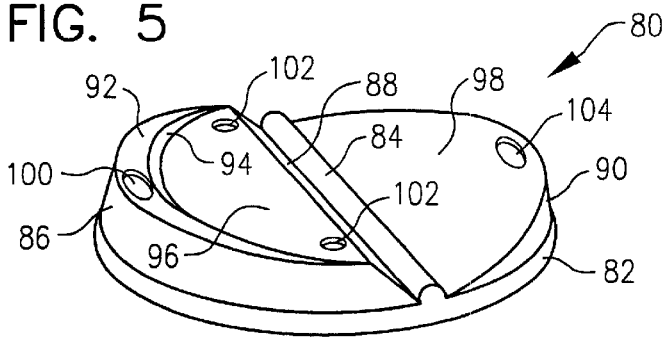
FIG. 5 illustrates one embodiment of a disposable lid which has been designed for use with the disposable baffle illustrated in FIG. 4 above.
Figure 6:
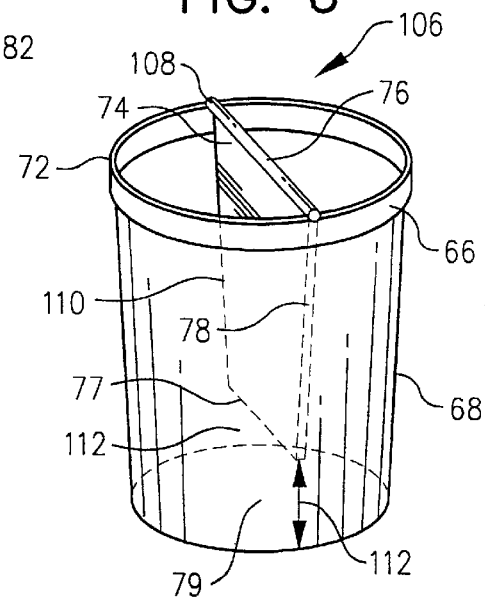
FIG. 6 is a perspective view of the baffle illustrated in FIG. 4, now shown inserted into the cup first illustrated in FIG. 3.

The baffle of 74 depicted in FIG. 4 is sized and shaped to slidably fit into the container 66 as depicted in FIG. 6. The baffle 74 may be fabricated from any number of materials including wax or resin impregnated paper, Styrofoam, plastic sheet or paperboard. The baffle 74 is topped with a bead 76 so that when the baffle 74 is inserted into the container 66, the rim 72 of the container 66 and the bead 76 of the baffle 74 form a continuous edge 108 to which the lid 80, depicted in FIG. 5, can be sealably attached. When the baffle 74 is inserted into the container 66, the baffle 74 frictionally seals against the side wall 68 so that neither air nor liquid will leak through the joint 110. The baffle side 78 is shorter than the container side wall 68 so that a gap 112 is created between the bottom 77 of the baffle 74 and the bottom 79 of the container 66 when the baffle 74 is fully inserted into the container 66.

Figure 7:
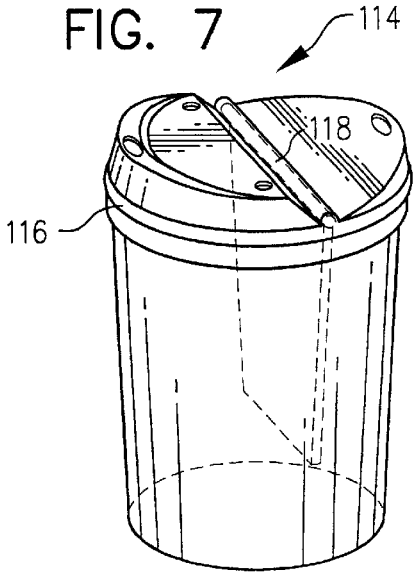
FIG. 7 shows the lid of FIG. 5 attached to the cup and baffle which were first illustrated in FIG. 6.
Figure 8:
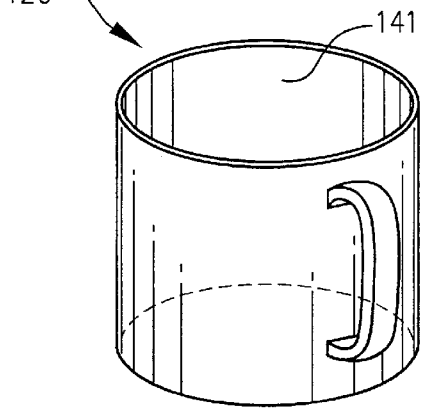
FIG. 8 is a perspective view of a cup of the ceramic or plastic type, with handle.

FIG. 5 depicts a lid 80, which covers the container 66. The lid 80 includes a recessed rim 82, which releasably attaches to the rim 72 of the container 66. The lid 80 also includes a grove 84, which engages the bead 76 of the baffle 74. When the baffle 74 is inserted into the container 66, as depicted in FIG. 6, and the lid 80 is attached to the baffle/container assembly 106, as depicted in FIG. 7, an air and water tight seal 116 is created between the container 66 and lid 80 and an air and water tight seal 118 is created between the baffle 74 and lid 80.

The lid 80 includes a tapering annular side wall 90 that extends upwardly from the recessed rim 82, and a large top wall 98 having a generally circular periphery adjoining the side wall 90 and sloping down to groove 84. The top wall 98 has an opening 104 adjacent to the periphery of the top wall 98, which allows vapor to pass through the lid 80. The lid 80 also includes an annular side wall 88 that extends upward from the recessed rim 82, and a groove side wall 88 that extends upward from the groove 84. A small top wall 96 adjoins the side wall 88 and has vent openings 102 near the edge where the small top wall 96 joins the groove side wall 88. A drink opening top wall 92 adjoins the side wall 86 and has a drink opening 100. The tapering annular side wall 94 depends downward from the drink opening top wall 92, and adjoins the small top wall 96. The side wall 86, drink opening top wall 92, and tapered annular side wall 94 are configured to allow the lips of the user to comfortably fit around the area of the drink opening 100.

The lid is frusto-conical shape (i.e., all angles are less than 90 degrees), which allows it to be constructed of a single piece of vacuum formed plastic and also allows multiple lids to be stacked for storage and shipment.

Figure 9:
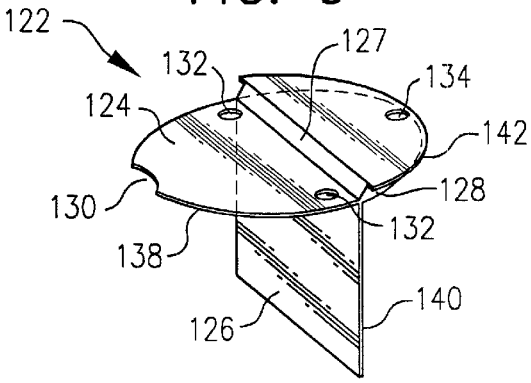
FIG. 9 illustrates a perspective view of a second embodiment of my vapor directing lid with vertical baffle, adapted for use in combination with a cup such as that first illustrated in FIG. 8.
Figure 10:
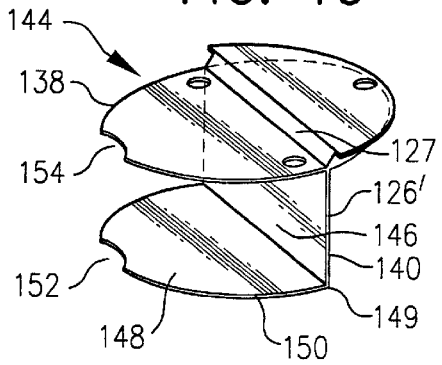
FIG. 10 shows yet another embodiment of my vapor directing cup insert, now shown utilizing both a vertical and a horizontal baffle.
Figure 11:
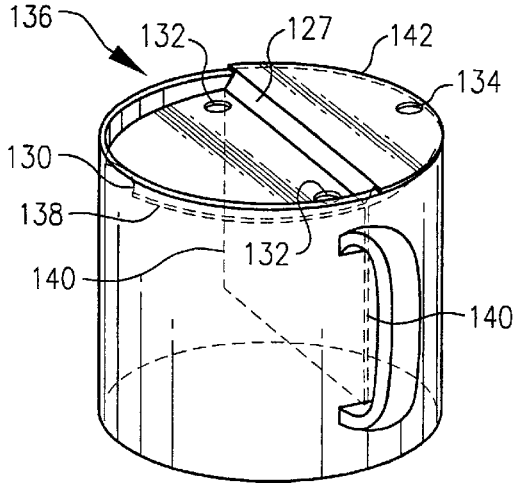
FIG. 11 shows the vapor-directing insert first illustrated in FIG. 9 installed for use in the cup illustrated in FIG. 8.

FIG.8 through FIG. 11 depict other alternative embodiments of the present invention. The cup 120 can be any conventional configuration including the common ceramic mug with a handle which is often used for drinking coffee and tea. FIG. 9 depicts a cup insert 122, which may be constructed from a single piece of injection molded plastic or from other relatively inexpensive materials such as ceramic, metal, wood, or paper. The cup insert 122 comprises a slopped circular top wall 124 and a vertical baffle member 126 that adjoins the top wall 124 at or near the top wall 124 diameter and extends perpendicularly downward. The outer circular rim 138 and the edges 140 of the baffle 126 frictionally engage the inner side wall of the cup 40 when the cup insert 122 is inserted into the cup 40 to create the cup/insert assembly 136, as depicted in FIG. 11. The outer rim 138 of the top wall 124 and edge 140 of the baffle 126 include a gasket or flap 127 which is preferably but not necessarily made out of the same material as the rest of the cup insert 122 but is thinner so as to be more flexible in order to assist in obtaining an air and water tight seal and to allow a single sized cup insert 122 to fit slightly different diameter cups. The sloping circular top wall 124 has a drink notch 130 at the lowest point when the cup insert 122 is inserted into the cup 120. The top wall 124 also includes vent openings 132 on the same side of the baffle member 126 as the drink notch 130 that are near to where the baffle member 126 joins the top wall 124. The top wall also includes a vent opening 134 that is on the opposite side of the baffle member 126 from the drink notch 130. The precise size, shape, location and number of vent openings 132 and 134 may vary depending upon the size and shape of the cup 120. However, there must always be at least one vent opening 134, which allows air pressure within the cup 120 to equalize when he cup 120 is tipped to the drinking position and back to the level position. Vent openings should also be located so that the beverage will not spill out of the vent openings when the cup is tipped to the drinking position. The cup insert 122 also includes a tapered side wall 128 which extends upward from the top wall 124 from that portion of the top wall rim that is on the opposite side of the baffle 126 from the drink notch 130. The rim 142 of the side wall 128 contains a bead or lip which prevents the cup insert 122 from being pushed too far into the cup 120. As depicted in FIG. 11, the rim 142 allows the insert to easily be inserted into and removed from the cup 120 and insures that the cup insert 122 is properly positioned in the cup 120 when the insert 122 is pushed into the cup 120 until the rim 142 rests against the lip of the cup, as shown in FIG. 11.

The cup insert embodiment 144 depicted in FIG. 10 is identical to the embodiment 122 depicted in FIG. 9 except that the vertical portion 146 of the baffle 126' is shorter and the baffle 126' has a horizontal portion 148 extending in a half circle from the bottom 149 of the vertical portion 146 of baffle 126'. The edge 150 of the horizontal portion 148 of the baffle frictionally engages the inner side wall 141 of the cup 120 in the same manner as the edges 140 of the vertical portion 146 of the baffle 126 frictionally engage the inner side wall 126' of the cup 120. The horizontal portion 148 of the baffle 126' has a notch 152, which allows air and liquid to pass between the horizontal portion 148 of the baffle 126' and the inner side wall 141 of the cup 120.

Figure 12:
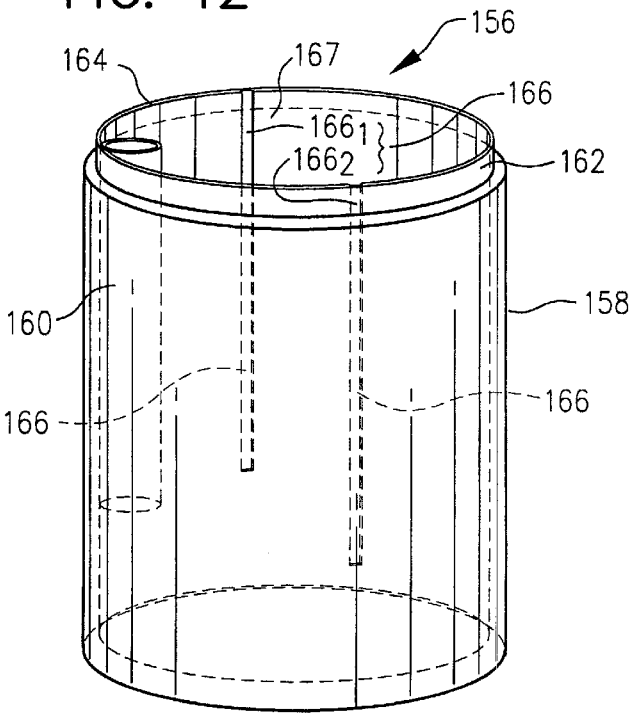
FIG. 12 shows a reusable beverage cup that has been manufactured with internal, downwardly directed alignment grooves sized and shaped for receiving therein a vertical baffle.
Figure 13:
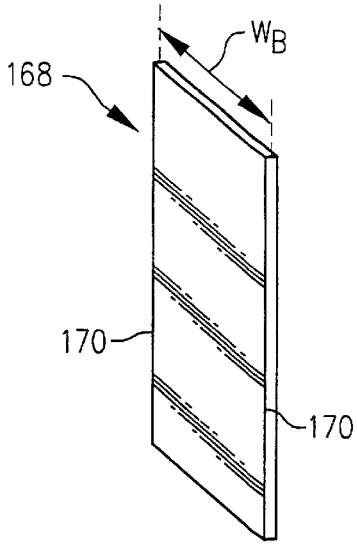
FIG. 13 is a perspective view of yet another embodiment for a vertical baffle.
Figure 14:
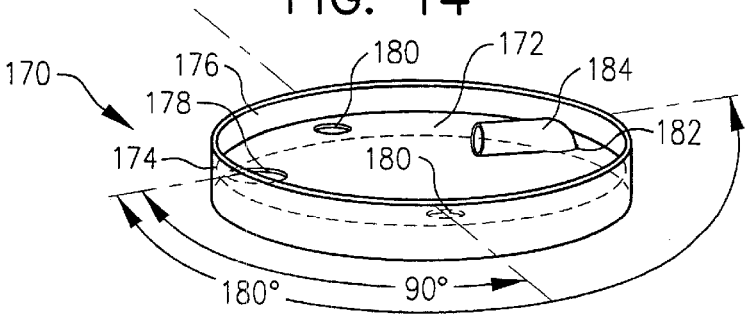
FIG. 14 is a still further embodiment of a reusable lid with vapor directing outlet.
Figure 15:
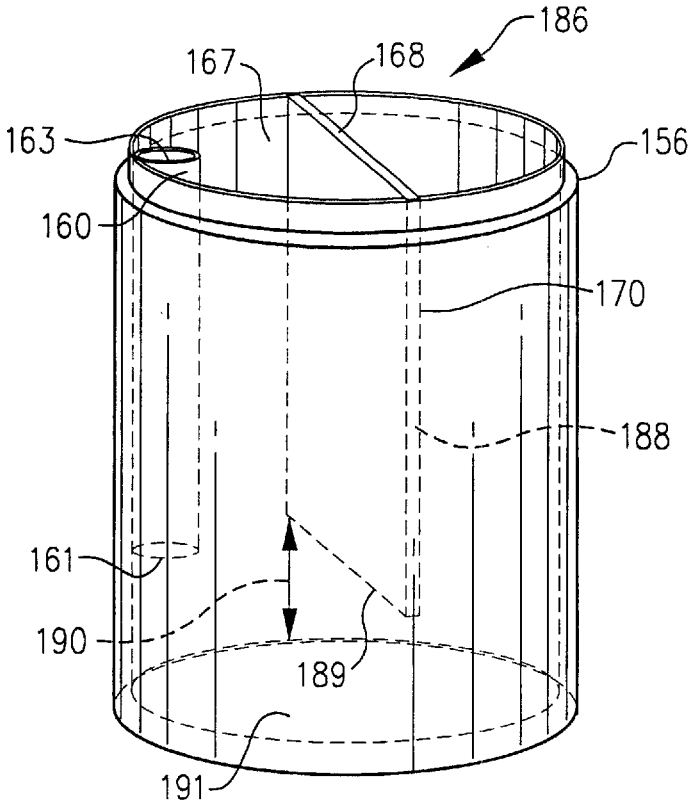
FIG. 15 is a perspective view of the cup first illustrated in FIG. 12, with the baffle first illustrated in FIG. 13 now inserted into a working position therein.

FIG. 12 through FIG. 16 depict yet another important embodiment of the present invention. The container 156, depicted in FIG. 12, is a reusable beverage cup, typically constructed of plastic, or aluminum, or stainless steel. The container 156 has an annular flanged neck 162 which may also include threading or similar features which allow the lid 170, depicted in FIG. 14 to be removably attached to the container 156, in the manner depicted in FIG. 16. The container 156 includes first $\mathbf{166}_1$ and second $\mathbf{166}_2$ grooves 166 on opposing sides of the interior side wall 167 of the container 156, to create a baffle space of a preselected width and shape. As illustrated, a constant width baffle space $W_s$ is created such that the baffle 168 of width $W_B$ fits sealingly between first $\mathbf{166}_1$ and second $\mathbf{166}_2$ grooves when inserted into the container 156, to create a container/baffle assembly 186, as depicted in FIG. 15. Thus, the baffle 168 is sized and shaped so that, when the baffle 168 is inserted into the container 156, an air and water tight seal 188 is created between the side edges 170 of the baffle 168 and the interior side walls 167 of the cup 156. However, a gap 190 remains between the bottom edge 189 of the baffle 168 and the base 191 of the cup 156 such that liquid my flow freely beneath the baffle 168. The container 156 also includes a tube 160 attached to the inner side wall of the container 156, tube 160 extending vertically down the side wall of container 156. The bottom 161 of tube 160 opens near the base 191 of container 156 and the top 163 of tube 160 opens at the rim of the container 156.

FIG. 14 depicts a lid 170 that includes a circular top wall 172 and also extends upward from the top wall 172 to create a drinking lip 176. The top wall 172 contains a drink opening 178 near the periphery of the top wall 172. The top wall 172 also includes vent openings 180 that are located near the periphery of the top wall 172 approximately 90 degrees from the drink opening 178 and adjacent to where the baffle 168 seals against the bottom of the top wall 172, when the lid 170 is attached to the baffle/container assembly 186. The vent openings 180 are on the same side of the baffle 168 as the drink opening 178. The lid 172 also includes a vent opening 182 which is near the periphery of the top wall 172 approximately 180 degrees from the drink opening 178. By locating the vent openings 180 and 182 as described above, beverage within the container 156 will not spill out the vent openings when the container 156 is tipped to the drinking position. A curved pipe 184 is attached to the vent opening 182 and extends horizontally on top of the top wall 172 toward the drink opening 178. This allows vapor to be forced out of the vent opening 182 and to be directed towards the user's nose, when the container 156 is tipped from the drinking position back to the level or vertical position. The vent openings 180 may also be ducted (not shown) to direct vapor as desired.

Figure 16:
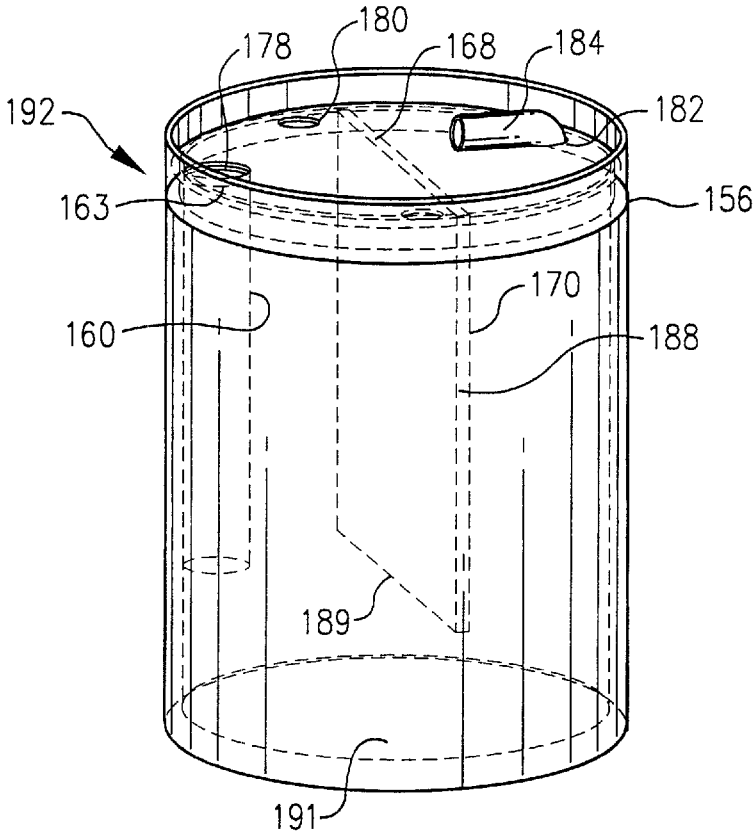
FIG. 16 is a perspective view that illustrates the lid first described in FIG. 14 installed for used on the cup first illustrated in FIG. 12, while utilizing the baffle first illustrated in FIG. 13.

When the lid 170 is attached to the baffle/container assembly 186, as depicted in FIG. 16, the drink opening 178 aligns with the top 163 of the tube 160 such that, when the lid 170 and container 156 and assembled into a vapor directing beverage container 192, which contains liquid and is tipped to the drinking position, only the vapor within the tube 160 is forced out the drink opening 178, thus allowing more vapor to be directed out the vent openings 180.

Figure 17:
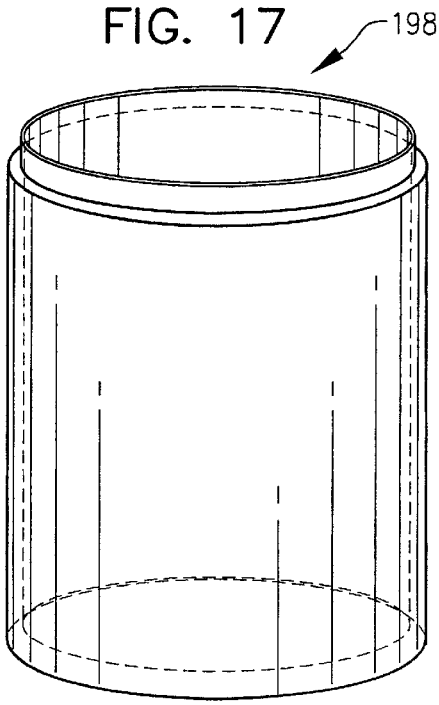
FIG. 17 is a perspective view of one embodiment of a reusable beverage cup having an upwardly directed opening with a flanged annular outlet rim.
Figure 18:
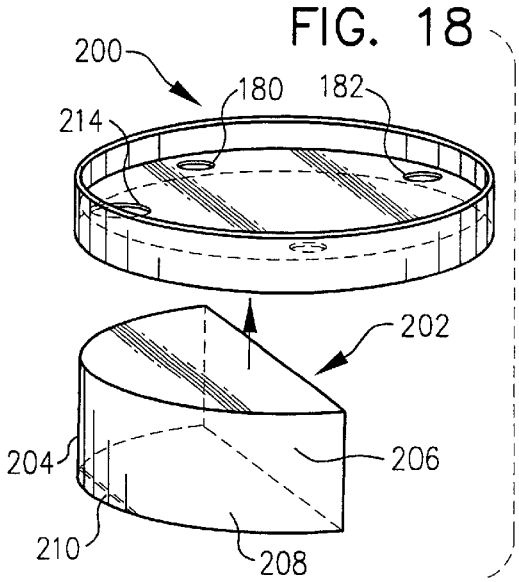
FIG. 18 is a perspective view of a reusable lid and baffle chamber, ready for mounting together to form a lid and baffle assembly.
Figure 19:
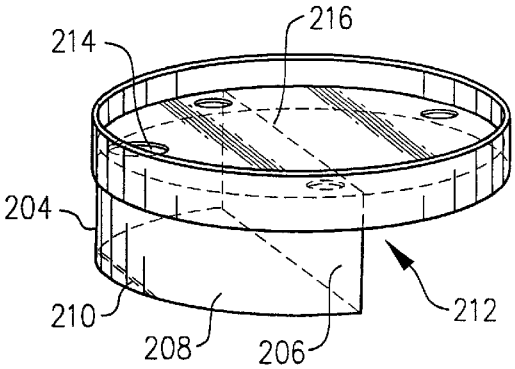
FIG. 19 is a perspective view of the reusable lid and baffle chamber first illustrated in FIG. 18, when fully assembled together for use.
Figure 20:
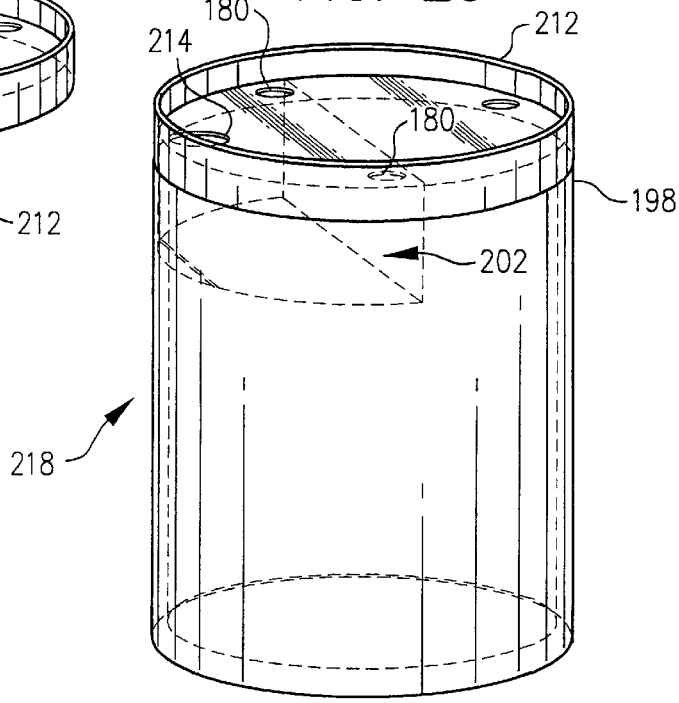
FIG. 20 is a perspective view of the lid and baffle assembly first illustrated in FIG. 19, mounted on the cup first illustrated in FIG. 17.

FIG. 17 through FIG. 20 depict yet another embodiment of the present invention. The container 198 depicted in FIG. 17 is the same as the container 156 depicted in FIG. 12, except that container 198 does not have grooves 166 and does not have a tube 160. The lid 200 is the same as the lid 170 (ducting 184 of the lid is not shown). However, in this alternative embodiment, the vertical baffle 168 is replaced with a baffle chamber 202, as depicted in FIG. 18. The baffle chamber 202 includes a curved side wall 204 and a rectangular side wall 206, both side walls extending upward from a baffle base 208. The baffle base 208 has an opening 210 which is directly beneath the drink opening 214 when the baffle chamber 202 is sealably attached along reference line location 216 to the lid 200, as depicted in FIG. 19. FIG. 20 depicts the lid/baffle chamber assembly 212 removably attached to the container 198. When the vapor directing beverage container 218 contains liquid and is tipped to the drinking position, vapor within the baffle chamber 202 is forced out the vent openings 180 and drink opening 214 as liquid flows into the baffle chamber 202 through the baffle base 208 opening 210.

Figure 21:
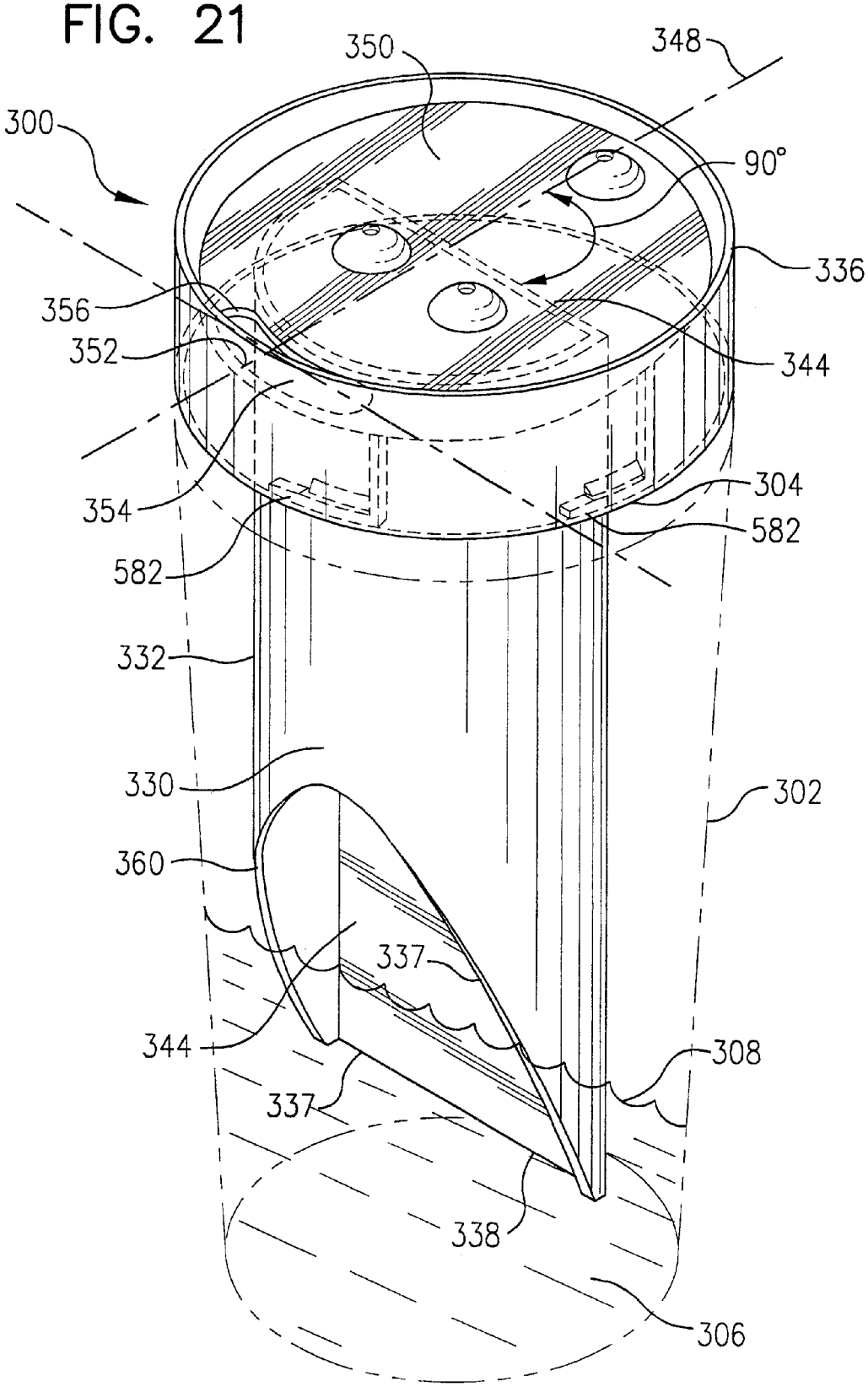
FIG. 21 shows a perspective view of one embodiment of my lid with tubular baffle assembly, shown inserted into a beverage container in a normal working configuration.
Figure 22:
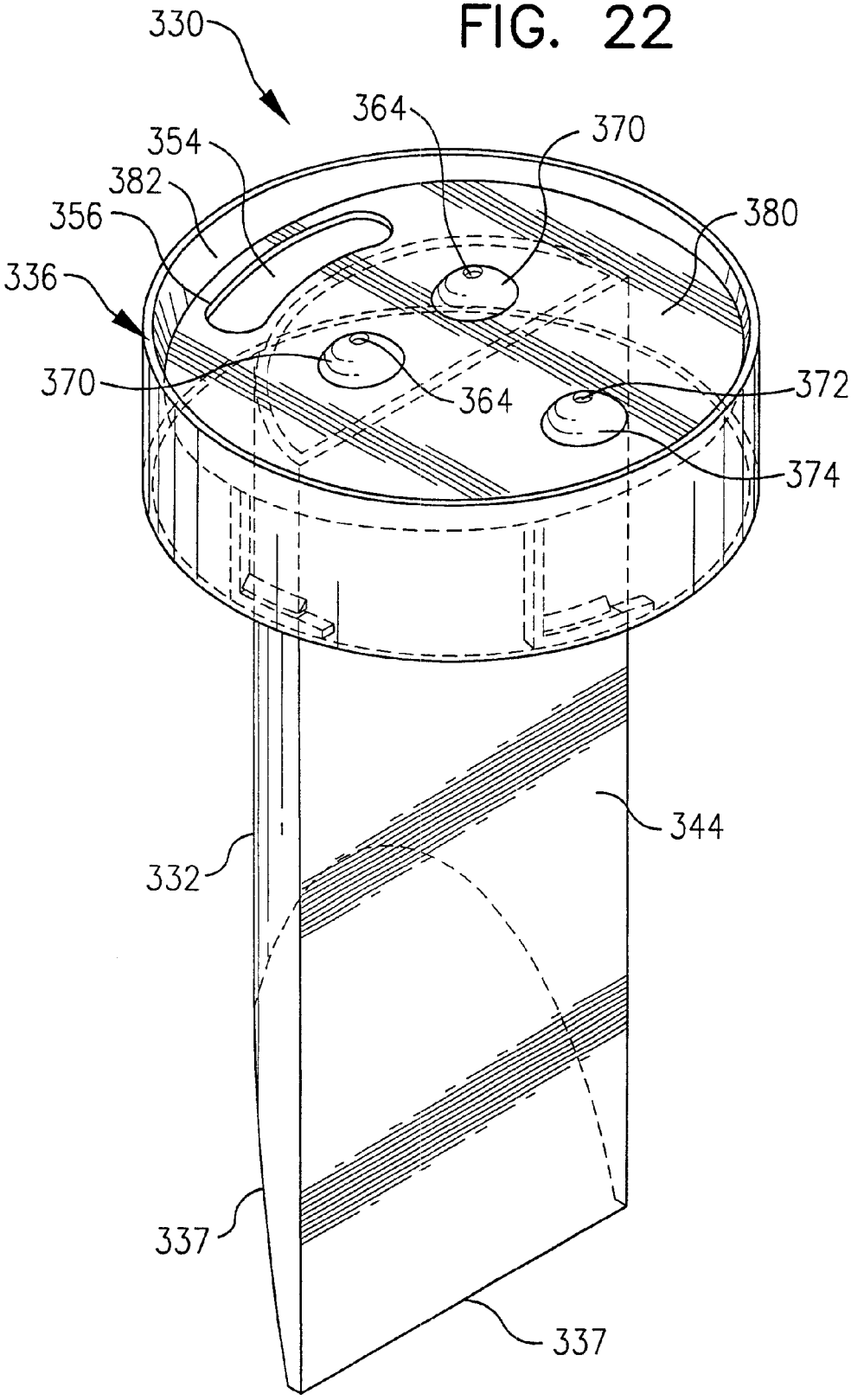
FIG. 22 illustrates a perspective view of the lid and tubular baffle assembly first shown in FIG. 21 above, now shown removed from a beverage container.
Figure 23:
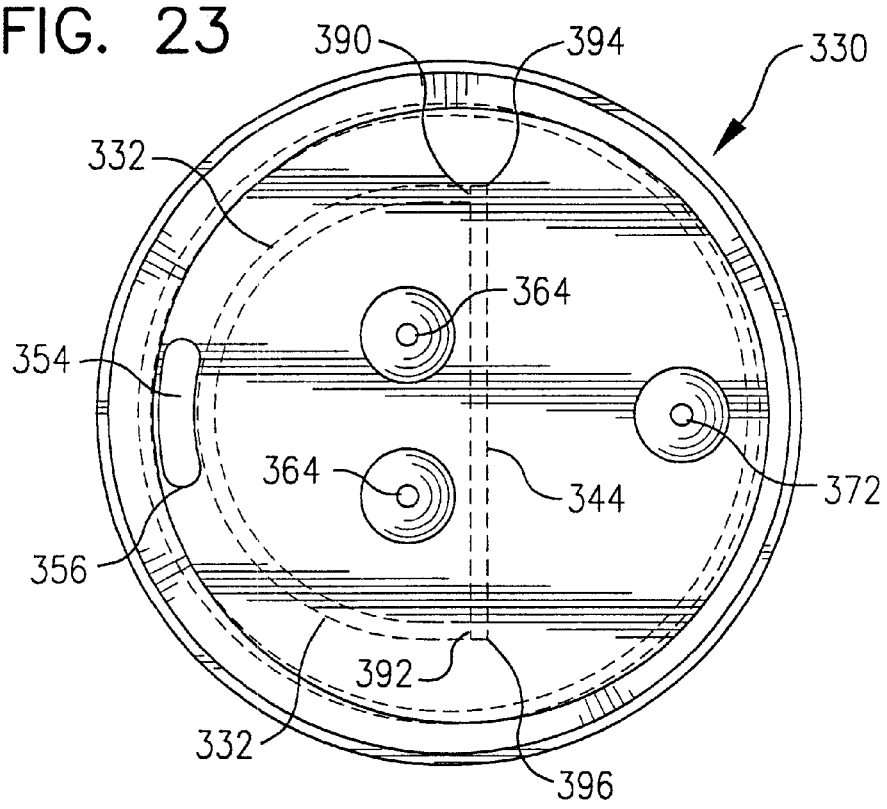
FIG. 23 shows a top view of the embodiment of the lid and tubular baffle assembly shown just shown in FIG. 21 and in FIG. 22.
Figure 26:
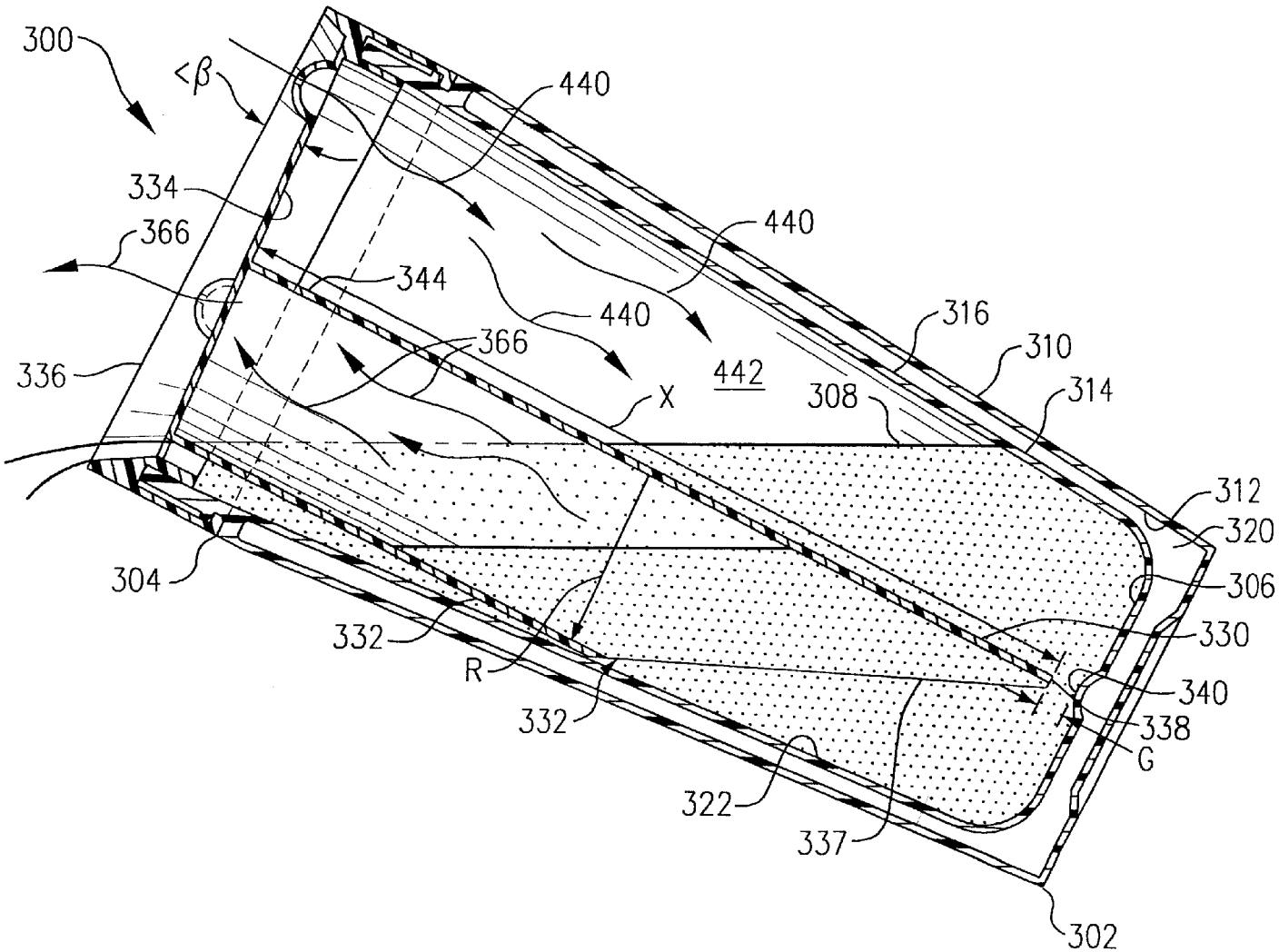
FIG. 26 shows a side cross-sectional view of the lid and integral baffle assembly first shown in FIGS. 21, 22, and 23, now showing the combination of an insulated beverage container having the lid thereon and the tubular baffle assembly therein, with the container in use, being tipped to dispense a beverage, and showing the flow of vapors through the lid and thus into and out of the container.

Attention is now directed to FIGS. 21–23, where yet another embodiment of my vapor directing beverage container assembly 300 is depicted. The vapor directing beverage container assembly 300 comprises a container 302 having an opening 304 and a bowl portion 306 for receiving and containing a liquid 308 therein (see FIG. 26). As shown in FIG. 26, the container 302 preferably includes a double walled insulating chamber comprising an outer wall 310 having an inner portion 312, an inner wall 314 having an outer portion 316, to provide a chamber 320 between the inner portion 312 of outer wall 310 and the outer portion 316 of the inner wall 314. The container 302 opening 304 is configured for receiving in suspended relationship within the bowl portion 306 and in a spaced relationship to the inner portion 322 of inner wall 314 an at least partially tubular baffle assembly 330. The tubular portion 332 of the baffle assembly 330 extends downwardly from the inner surface 334 of lid 336 for a preselected distance X to a lower end portion 337 having a bottom end 338, so that a relatively small gap G is provided between the bottom end 338 of the baffle assembly 330 and the bottom portion 340 of the inner portion 322 of inner wall 314 of container 302. For example, in a typical container 302 having an overall exterior height of a little more than about 6 inches, the downwardly extending length X of baffle assembly 330 is about 0.25 inches less than than that of the interior height, or slightly less than about 6 inches, leaving a clearance gap G of about 0.25 inches. In the downwardly extending tubular portion 332 of the baffle assembly 330, I also prefer that the central wall portion 344 be provided oriented in a plane perpendicular to a reference diameter line 348 of the lid 336, when the reference diameter line 348 is depicted through the center 352 of liquid outlet 354 (defined by edgewall 356) in the lid 350.

Figure 27:
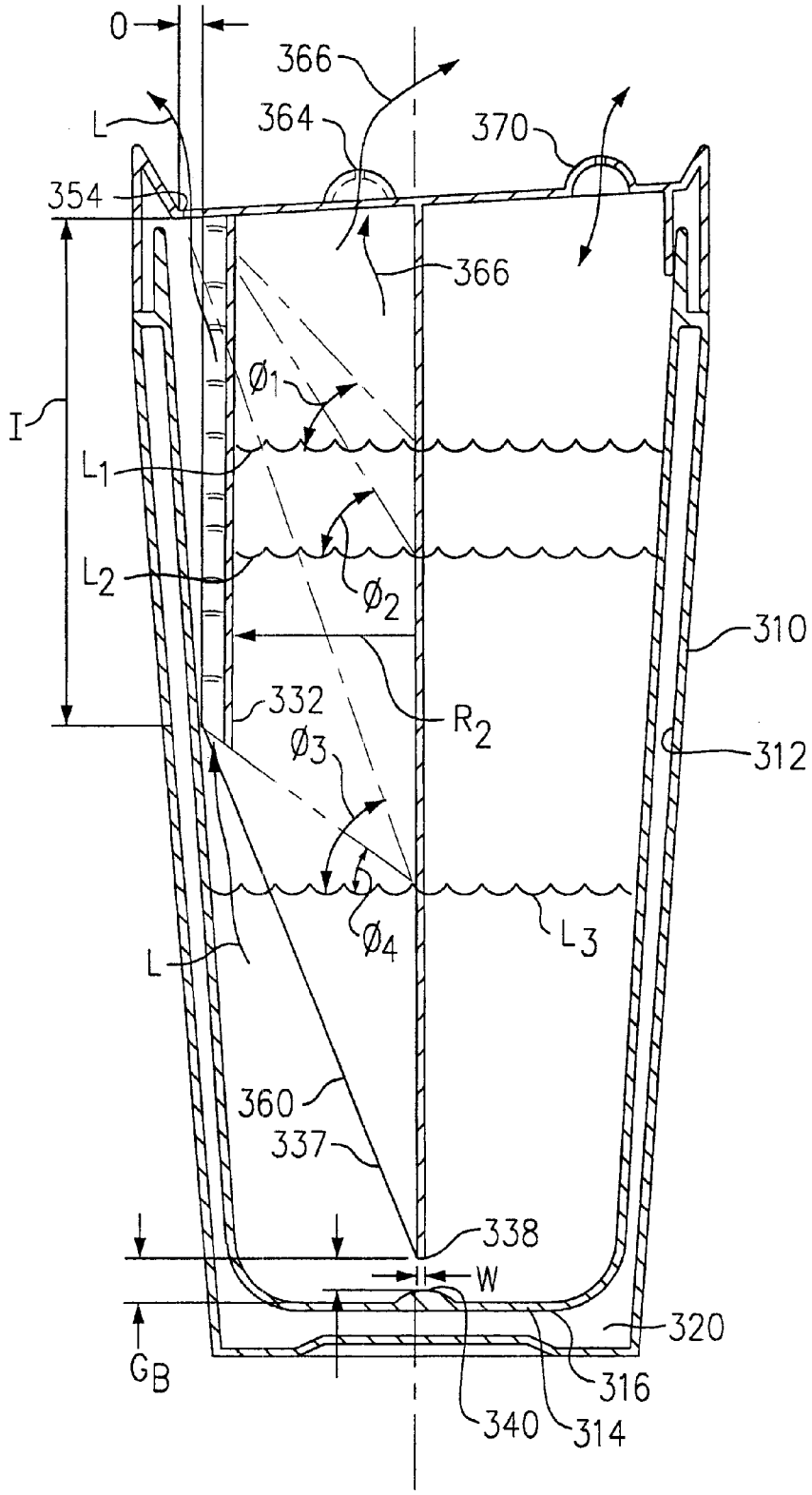
FIG. 27 shows a vertical cross-sectional view of the lid and integral baffle assembly first shown in FIGS. 24, and 25, now showing the combination of an insulated beverage container having the lid thereon and the tubular baffle assembly therein, with the container in use, being tipped to dispense a beverage, and showing the flow of vapors through the lid and thus into and out of the container; also shown are liquid levels and accompanying vapor volumes at various tilt angles theta (ø).

I have also developed and disclose herein a baffle structure in which the volume of vapor pumped is controlled by the shape of the baffle outlet, so that a relatively smooth vapor volume curve is provided for various liquid volumes in a container 302. This is achieved by evaluating the volume pumped at various liquid levels in the container, and by then providing a sliced outlet shape 360 that becomes sealingly effective only at a preselected tilt angle theta (ø) for a preselected liquid level. This is illustrated in FIG. 27, where at liquid level $L_3$, the container must be tilted an angle theta$(ø)_4$ before the tubular portion 332 of tubular baffle assembly 330 becomes effective. Then, before liquid becomes available at the liquid outlet 354, the container 302 must be additionally tilted by a further angle, theta $(ø)_3$–theta $(ø)_4$, at which time the user can sip liquid L from the outlet 354. This is important because without the angularly sliced tubular baffle outlet 360, when liquid levels are low in the container, high vapor volumes would be pumped through the at least one vapor passageways 364 which allow vapor 366 to escape from tubular portion 332 of the tubular baffle assembly 330.

This design feature is more rigorously evaluated from the selected geometry for a tubular baffle assembly. For a simple case of a tubular baffle assembly of semi-circular cross section having an interior radius R (see FIG. 26), the volume of vapor pumped when the container 302 is titled is equal to $2/3\ R^3 \tan Ø$, where theta (ø) is the angle between the liquid L surface at rest and the liquid surface L at the point the container 302 reaches an angle wherein liquid L is available at the drink opening outlet 354. As shown in FIG. 27, at liquid level $L_1$ (i.e, the container is nearly full), the pumped volume in a container having a semi-circular tubular baffle assembly having a one inch radius R, where theta (ø) is 58 degrees, (where pumped volume is the amount of vapor attempting to exit through vapor passageway 364) is 1.067 cubic inches. Then, at liquid level $L_2$, and where theta (ø) is 66 degrees, the pumped vapor volume is 1.497 cubic inches. At $L_3$, where theta (ø) is 72 degrees, the vapor volume displaced is 1.493 cubic inches, due to the sliced outlet 360 shape as defined by the end edge portions thereof. In the absence of the sliced outlet shape, the volume displaced would be 2.052 cubic inches. Thus, my sliced tubular portion of the tubular baffle, as defined by an inlet edge portion 37, allows a more uniform pumping volume to be achieved, when compared to tubular baffle structures wherein all sidewalls of the tubular portion of the baffle extend downward for the same preselected distance.

However, these dimensions are provided by way of example and should not be construed in any way to be a limitation, as many other configurations for the baffle assembly 330 may be utilized to achieve the vapor pumping method taught herein.

In FIG. 22, a perspective view of the lid 336 and tubular baffle assembly 330 first shown in FIG. 21 above is illustrated, now shown removed from a beverage container 302. Note the that two first vapor passageways 364 (at least one is necessary) are provided in the dome-shaped outlet structures 370. Also, note that a single second vapor passageway 372 is provided in a second dome-shaped outlet structure 374. The top surface 380 of lid 336 is sloped at an angle beta (β) from being perpendicular to the longitudinal axis of the container 302, to allow liquid to accumulate in rim 382 (see FIG. 26).

FIG. 23 shows a top view of the embodiment of the lid and tubular baffle assembly 330 shown just shown in FIG.

21 and in FIG. 22. Note that in this embodiment, the tubular portion 332 of the tubular baffle assembly may be provided in a circular, or elliptical cross section shape. However, an arcuate cross-sectional shape for this component need not be so limited. Tubular portion 332 has opposing end walls 390 and 392 that sealingly mate with distal edges 394 and 396 of the central wall 344. Preferably, the tubular portion is manufactured in a single, integral, one-piece assembly, and thus there are no seals to consider.

Figure 24:
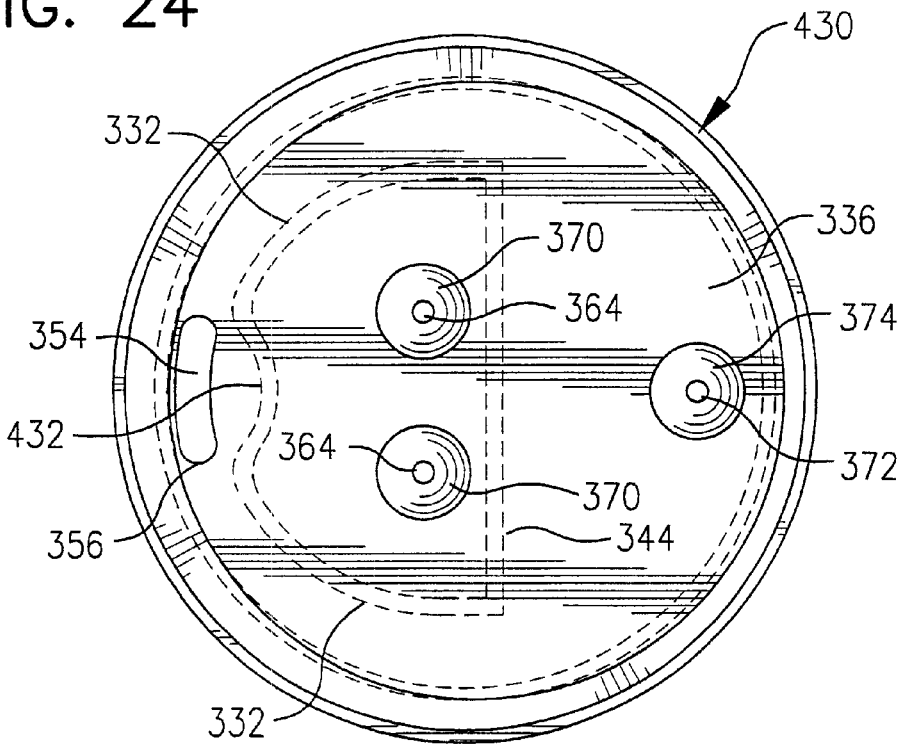
FIG. 24 shows a top view of yet another embodiment of my lid and tubular baffle assembly, similar to that just illustrated in FIGS. 21, 22, and 23, but now utilizing a partial-pipe portion running longitudinally along the tubular portion of the tubular baffle assembly, and adjacent to the liquid outlet.

FIG. 24 shows a top view of yet another embodiment 430 of my lid and tubular baffle assembly, similar to that just illustrated in FIGS. 21, 22, and 23, but now utilizing a partial-pipe portion 432 running longitudinally along the tubular portion 332 of the tubular baffle assembly, and adjacent to the liquid outlet 354.

Figure 25:
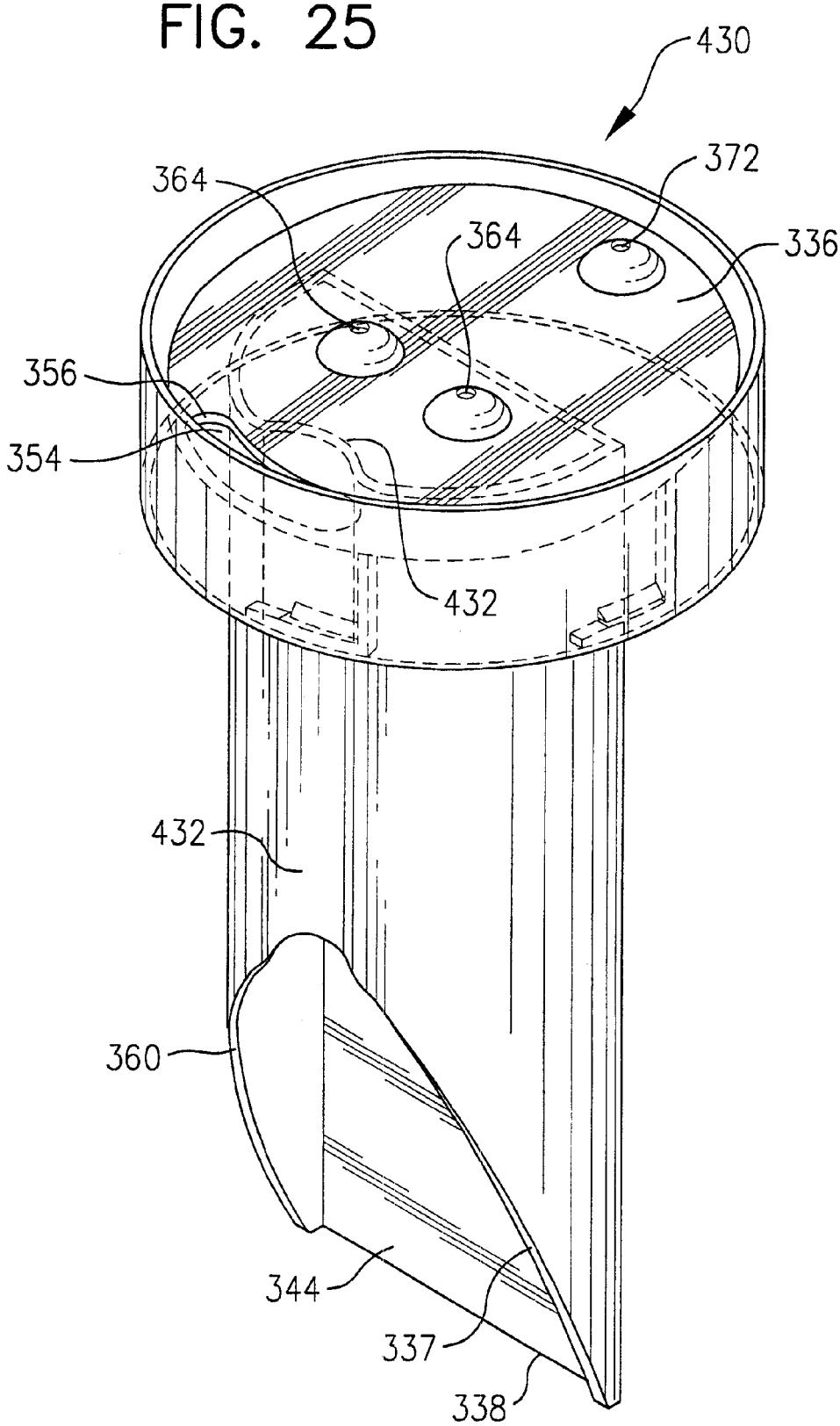
FIG. 25 shows a top perspective view of the embodiment of my lid and tubular baffle assembly just illustrated in FIG. 24, showing the partial-pipe indentation portion running longitudinally along the tubular portion of the tubular baffle assembly and placed adjacent to the liquid outlet in the lid.

FIG. 25 shows a top perspective view of the embodiment of my lid and tubular baffle assembly 430 just illustrated in FIG. 24, showing the partial-pipe indentation 432 running longitudinally along the tubular portion 332 of the tubular baffle assembly and placed adjacent to the liquid outlet 354 in the lid 336.

As discussed above, FIG. 26 shows a side cross-sectional view of the lid and integral baffle assembly 330 first shown in FIGS. 21, 22, and 23, now showing the combination of an insulated beverage container 302 having the lid 336 thereon and the tubular baffle assembly 330 therein, with the container 302 in use, being tipped to dispense a beverage with liquid level L, and showing the flow of vapors 366 through the lid 336 and thus out (as well as in to, via arrows 440 to ullage space 442) of the container 302.

FIG. 27 shows a vertical cross-sectional view of the lid and integral tubular baffle assembly 430 first shown in FIGS. 24, and 25, now showing the combination of an insulated beverage container 302 having the lid thereon and the tubular baffle assembly therein, with the container 302 in use, being tipped to dispense a beverage with liquid level L, and showing the flow of vapors through the lid and thus into and out of the container; also shown are liquid levels and accompanying vapor volumes at various tilt angles theta (ø).

Figure 28:
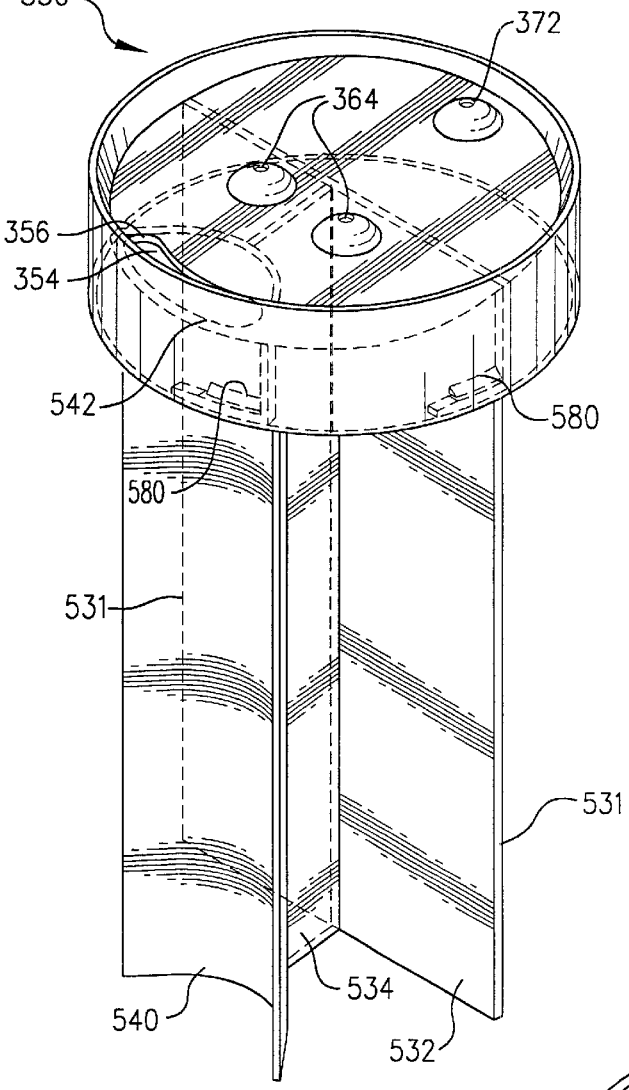
FIG. 28 shows a perspective view of a lid for a container, where the lid includes a main baffle, a downwardly extending central baffle transversely oriented to the main baffle and sealingly affixed to the center of the main baffle, and a generally U-shaped partial-pipe sealingly affixed to the central baffle.
Figure 29:
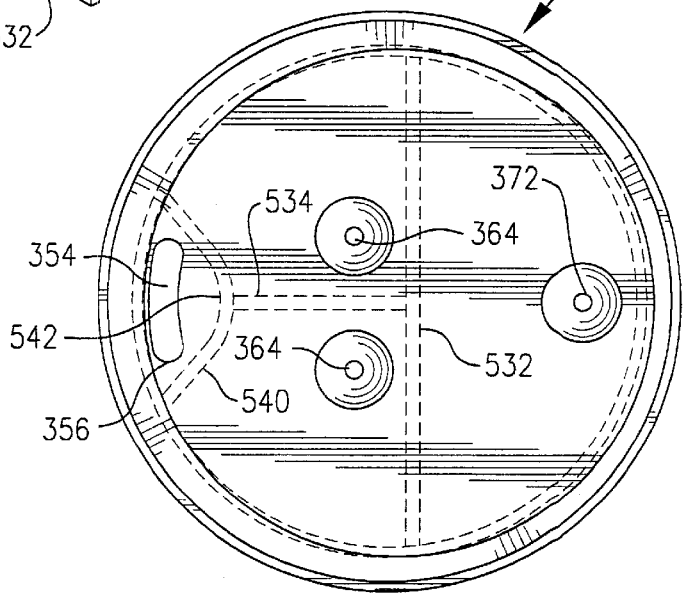
FIG. 29 shows a top view of yet another embodiment of my lid and tubular baffle assembly, in some respects similar to the embodiment just shown in FIGS. 24 and 25, but now including laterally sealing main baffle, a downwardly extending central baffle sealingly affixed to the center of the main baffle, and a generally U-shaped partial-pipe outlet sealingly affixed to the central baffle in a position to direct a liquid flow path along the partial-pipe outlet, in order to enhance availability of liquid from the container.

Finally, FIGS. 28 and 29 shows a top view of yet another embodiment of my lid and tubular baffle assembly 530, which is in some respects similar to the embodiment 430 just shown in FIGS. 24 and 25. This embodiment includes a lateral edge 531 sealing main baffle 532, a downwardly extending central baffle 534 sealingly affixed to the center of the main baffle, and a generally U-shaped partial-pipe outlet 540 sealingly affixed to the central baffle 534, in a position to direct a liquid flow path along the partial-pipe outlet 542, in order to enhance availability of liquid from the container. FIG. 26 also illustrates attachment teeth 580 which are provided for close meshing engagement with attachment ledges 582 in container 302.

It is to be appreciated that my unique beverage containers, when used in combination with my vapor pumping baffle lids for the same, provide an appreciable improvement in the art of beverage containers or consumption of aromatic beverages. My novel vapor pumping lids for such containers addresses the problem of aromas reaching the consumer of the liquid, to provide a significantly improved experience for the user consuming an aromatic beverage such as hot coffee. Although only a few exemplary embodiments of this invention have been described in detail, it will be readily apparent to those skilled in the art that my vapor pumping beverage container lid structure may be modified from those embodiments provided herein, without materially departing from the novel teachings and advantages provided.

It will thus be seen that the objects set forth above, including those made apparent from the preceding description, are efficiently attained. Since certain changes may be made in designing the described structures when placing such structures into mass production, it is to be understood that my invention may be embodied in other specific forms without departing from the spirit or essential characteristics thereof. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise embodiments disclosed. The intention is to cover all modifications, equivalents, and alternatives falling within the scope and spirit of the invention, as expressed herein above and in the appended claims. As such, the claims are intended to cover the methods, apparatus, structures, and not only the equivalent methods or structural equivalents thereof, but also equivalent methods or structures. The scope of the invention, as described herein is thus intended to include variations from the embodiments provided which are nevertheless described by the broad meaning and range properly afforded to the language herein, as explained by and in light of the terms included herein, or the legal equivalents thereof.

What is claimed is:

1. A vapor directing beverage container, comprising:

(a) containing means for containing liquid;

(b) covering means for covering said containing means, said covering means sealably attaching to said containing means and having at least a first opening means and a second opening means;

(c) baffle means for dividing said containing means into at least a first chamber means and a second chamber means, said baffle means being shaped and positioned to allow liquid in said containing means to flow freely between each of said chamber means, said baffle means being sealed against said covering means and shaped and positioned to prevent vapor within said first chamber means that is between said covering means and liquid in said containing means from flowing to said second chamber means;

(d) said covering means associated with each of said chamber means having at least a first of said opening means through said covering means, such that, when said containing means contains liquid and is tipped to allow liquid to flow out of at least a first of said opening means in said covering means, vapor within said first chamber means is forced out of at least a first of said opening means associated with said first chamber means, while vapor outside said container means is simultaneously drawn into at least said second chamber means through at least a first of said opening means associated with said second chamber means.

2. The combination of a container and a vapor directing beverage container lid, comprising:

(a) a container comprising an opening and a bowl portion, said bowl portion adapted for holding liquid therein;

(b) a lid releasably and sealably covering said opening of said container, said lid having two or more openings therethrough;

(c) a baffle in said container that seals against said lid, said baffle shaped and positioned within said container to create at least first and second chambers, said baffle further shaped and positioned to allow liquid in said container to flow freely between said at least first and second chambers, said baffle further shaped and positioned to prevent vapor located between said lid and said liquid within a first chamber in said container from flowing to a second chamber; and (d) wherein said baffle is shaped and positioned so that at least one of said openings in said lid is associated with said first chamber and at least one of said openings in said lid is associated with said second chamber, such that when said container contains liquid and is tipped to allow liquid to f low out of at least one of said openings in said lid, vapor within said first chamber is forced out of one or more openings in said lid associated with said first chamber while vapor outside said container is simultaneously drawn into said container through one or more openings in said lid associated with said second chamber.

3. The combination as set forth in claim 2, wherein said lid further comprises:

(a) an annular rim, said annular rim configured to enable said lid to be removably attached to said container;

(b) an annular side wall extending upward from said annular rim;

(c) a circular top wall depending from said annular side wall, said circular top wall having (i) a drink opening adjacent to the periphery of said top wall, (ii) a groove in the bottom surface of said top wall that extends from one edge of said top wall at a point that is about 90 degrees from said drink opening to the opposite edge of said top wall at a point that is also about 90 degrees from said drink opening, said groove allowing said baffle to be removably attached to said lid, (iii) at least a first vent opening adjacent to the periphery of said top wall at a point about 180 degrees from said drink opening, (iv) at least a second vent opening adjacent to said groove and on the same side of said groove as said drink opening.

4. The combination as set forth in claim 3, wherein said annular sidewall is frusto-conical in shape.

5. The combination as set forth in claim 2 wherein at least one of said openings in said lid associated with said first chamber is ducted, so that the out-flow of vapor exiting said opening is sent in a preselected direction.

6. The combination as set forth in claim 2 wherein:

(a) said container comprises (i) a base, (ii) side walls extending upwards to a top from said base and cooperating with said base to form a container for holding liquid, (iii) a tube attached to an inner portion of said side walls of said container, said tube extending vertically downward, said tube having a bottom opening and a top opening, said bottom opening located near the base of said container, said top opening located near the top of said side wall; and, (b) wherein said lid comprises (i) a bottom, (ii) at least a first vent opening, and wherein one of said at least a first vent openings is located on the same side of said baffle as said at least a first of said openings in said lid associated with said first chamber, (iii) a means for removably attaching said lid to said container such that when said lid is attached to said container, said at least a first of said openings in said lid associated with said first chamber aligns with said top tube opening (iv) said top tube opening sealing against said bottom of said lid such that when said container contains liquid and is tipped from a level position to a drinking position, only the vapor within said tube flows out said at least a first of said openings in said lid associated with said first chamber, thus allowing more vapor to be directed out at least a first said vent opening.

7. The combination as set forth in claim 3 wherein:

(a) said container comprises a circular base with side walls extending upwards from said base to a circular rim; and (b) wherein said baffle comprises a vertical extension which, when inserted into said container, seals against said side walls of said container near the diameter of said container; and (c) wherein said drink opening in said lid is near the point along the periphery of said lid which is 90 degrees from the points along said rim of said container where said baffle seals against said container side wall.

8. The combination as set forth in claim 3 wherein:

(a) said container comprises (i) a circular base wall, and (ii) side walls extending upwards from said base wall to a circular rim;

(b) said lid comprises (i) a horizontal top wall having a top and bottom, (ii) vertical side walls extending downward from said top wall;

(c) said baffle comprises a baffle chamber, said baffle chamber further comprising a horizontal baffle chamber base that is approximately a half circle in shape, said baffle chamber base being sized and shaped to fit within said container and seal against said side walls of said container, and baffle chamber side walls said baffle chamber side walls extending upward from the periphery of said baffle chamber base and sealably attaching to the bottom of said lid;

(d) said baffle chamber base has an opening near the point along the periphery of said baffle chamber base which is 90 degrees from the end points of the straight edge of said baffle chamber base; and (e) said drink opening in said lid is located near the point along the periphery of said lid top wall which is directly above said baffle chamber opening.

9. The combination as set forth in claim 2, wherein said lid comprises (i) a liquid outlet, (ii) at least one first vapor passageway, (iii) at least one second vapor passageway, and wherein said baffle comprises a tubular baffle assembly, said tubular baffle assembly having an upper end portion sealingly secured to and depending from said inner surface of said lid and a tubular portion extending downwardly for a preselected distance into said bowl portion of said container to a lower end portion having a opening; and wherein said at least one first vapor passageway comprises a port through said lid positioned for vapor communication between said tubular portion of said baffle assembly and ambient air, and wherein said at least one second vapor passageway comprises a port through said lid positioned for vapor communication between ambient air and a ullage space within said bowl of said container external to said tubular portion of said tubular baffle assembly.

10. The combination as set forth in claim 9, wherein said tubular baffle assembly is sealingly affixed to said inner surface portion of said lid.

11. The combination as set forth in claim 9, wherein said tubular baffle assembly and said lid comprise an integral, one-piece molded component.

12. The combination as set forth in claim 9, or in claim 11, wherein said tubular baffle assembly further comprises a central wall.

13. The combination as set forth in claim 12, wherein said central wall is planar.

14. The combination as set forth in claim 12, wherein said central wall extends between said inner surface of said lid and said lower end portion of said tubular baffle assembly.

15. The combination as set forth in claim 12, wherein said central wall is oriented substantially perpendicular to a reference line of diameter across said lid, and wherein said reference line of diameter is placed perpendicular to a reference tangent line adjacent said liquid outlet.

16. The combination as set forth in claim 12, wherein said tubular baffle assembly comprises an outer wall portion having an outer surface portion with an elliptical cross-section, said outer wall portion having opposing end edge portions each sealingly affixed to said central wall.

17. The combination as set forth in claim 12, wherein said tubular baffle assembly comprises an outer wall portion having an outer surface portion with a circular cross-section, said outer wall portion having opposing end edge portion each sealingly affixed to said central wall.

18. The combination as set forth in claim 12, wherein said tubular baffle assembly comprises an outer wall portion having a curved, arcuate cross-section, said outer wall portion having opposing end edge portions each sealingly affixed to said central wall.

19. The combination as set forth in claim 16, wherein said outer wall portion is disposed downwardly from said inner surface of said lid at a location between said liquid outlet and the intersection of said planar central wall with said inner surface of said lid.

20. The combination as set forth in claim 17, wherein said outer wall portion is disposed downwardly from said inner surface of said lid at a location between said liquid outlet and the intersection of said planar central wall with said inner surface of said lid.

21. The combination as set forth in claim 18, wherein said outer wall portion further comprises a downwardly and inwardly sliced shape defining a first portion of said outlet of said tubular baffle assembly.

22. The combination as set forth in claim 13, wherein said planar central wall further comprises a rectangular shaped wall, said rectangular shaped wall having a lower end comprising a second portion of said outlet of said tubular baffle assembly.

23. The combination as set forth in claim 9, further comprising two or more first vapor passageways.

24. The combination as set forth in claim 9, wherein said lid further comprises an upwardly oriented annular rim having an internal surface, and wherein said lid is oriented inwardly and downwardly by an angle beta (β) between an upper end and said liquid outlet, so as to provide room for liquid accumulation external to said lid adjacent to said internal surface of said annular rim.

25. The combination as set forth in claim 9, wherein said lid further comprises a downwardly oriented annular sidewall, and wherein said container further comprises an upwardly oriented external connection flange, said annular sidewall and said connection flange sized and shaped for close fitting sealing engagement.

26. The combination as set forth in claim 25, wherein said connection flange further comprises a plurality of outwardly and upwardly sloped attachment ledges, and wherein said annular sidewall further comprises a plurality of attachment teeth downwardly and inwardly oriented complementary to said attachment ledges, and wherein by bringing said attachment teeth into close meshing engagement with said attachment ledges, said lid is securely and sealingly positioned to said outlet of said container.

27. The combination as set forth in claim 2 or in claim 9, wherein said container further comprises an outer wall having an inner surface, and an inner wall having an outer surface, said inner surface and said outer surface forming therebetween an insulating chamber.

28. The combination as set forth in claim 17, wherein said bowl portion of said container comprises a bottom portion, and wherein said lower end of said tubular baffle portion is closely separated from said bottom portion by a gap $G_B$.

29. The combination as set forth in claim 28, wherein said gap $G_B$ is approximately 0.25 inches.

30. The combination as set forth in claim 19, wherein said downwardly and inwardly sliced shape has an inlet edge portion, and wherein said inlet edge portion is sized and shaped for being closely disposed adjacent to, but separated by a preselected gap distance, from said interior portion of said inner wall of said container.

31. The combination as set forth in claim 30, wherein said preselected gap distance $G_T$ is about 0.003 inches, or greater.

32. The combination as set forth in claim 9 wherein said preselected distance that said tubular portion extends downwardly from said inner surface portion is variable in length, along at least a portion of said lower end portion of said tubular portion.

33. The combination as set forth in claim 9, wherein said tubular baffle assembly further comprises a partial-pipe element, said partial-pipe element running longitudinally along at least a portion of said tubular portion of said tubular baffle assembly oriented toward said liquid outlet in said lid, so as to form a liquid accepting indentation in said at least a portion of said tubular portion of said tubular baffle assembly.

34. The combination as set forth in claim 33, wherein said partial-pipe element comprises a broad U-shaped indentation in said tubular portion of said tubular baffle assembly.

35. A beverage container lid for use with a liquid container having an upwardly directed opening and a bowl portion adapted for containing a liquid therein, said lid comprising:

(a) a lid base, said lid base releasably and sealably positionable on a container while overlying said opening, said lid having an inner surface portion, said lid further comprising
  (i) a liquid outlet,
  (ii) at least one first vapor passageway,
  (iii) at least one second vapor passageway,
  (iv) a tubular baffle assembly, said tubular baffle assembly having an upper end portion sealingly secured to and depending from said inner surface portion of said lid and a tubular portion extending downwardly for a preselected distance into said bowl portion of the container to a lower end portion having an opening;

(b) wherein said at least one first vapor passageway comprises a port through said lid positioned for vapor communication between said tubular portion of said baffle assembly and ambient air, and wherein said at least one second vapor passageway comprises a port through said lid positioned for vapor communication between ambient air and a ullage space within the bowl of the container external to said tubular portion of said tubular baffle assembly.

36. The beverage container lid as set forth in claim 35, wherein said tubular baffle assembly is sealingly affixed to said inner surface portion of said lid.

37. The beverage container lid as set forth in claim 35, wherein said tubular baffle assembly and said lid base comprise an integral, one-piece molded beverage container lid.

38. The beverage container lid as set forth in claim 35, wherein said tubular baffle assembly further comprises a central wall.

39. The beverage container lid as set forth in claim 38, wherein said central wall is planar.

40. The beverage container lid as set forth in claim 38, wherein said central wall extends between said inner surface of said lid base and said lower end portion of said tubular baffle assembly.

41. The beverage container lid as set forth in claim 40, wherein said central wall is oriented substantially perpendicular to a reference line of diameter across said lid, and wherein said reference line of diameter is placed perpendicular to a reference tangent line adjacent said liquid outlet.

42. The beverage container lid as set forth in claim 35, wherein said tubular baffle assembly further comprises a partial-pipe element, said partial-pipe element running longitudinally along at least a portion of said tubular portion of said tubular baffle assembly and oriented toward said liquid outlet in said lid, so as to form a liquid accepting indentation in said at least a portion of said tubular portion of said tubular baffle assembly.

43. The beverage container lid as set forth in claim 42, wherein said partial-pipe element comprises a broad U-shaped indentation in said tubular portion of said tubular baffle assembly.

44. The combination as set forth in claim 2, wherein said lid has an inner surface portion, and wherein said lid further comprises (i) a liquid outlet, (ii) at least one first vapor passageway, (iii) at least one second vapor passageway, and wherein said baffle comprises a tubular baffle assembly, said tubular baffle assembly having an upper end portion sealingly secured to and depending from said inner surface portion of said lid and a tubular portion extending downwardly for a preselected distance into said bowl portion of said container to a lower end portion having an opening, said tubular portion having a transverse area, and wherein said lower end portion, said preselected length, and said transverse area define a maximum vapor capture volume in said tubular portion, and wherein said transverse area and a tilt angle theta (Ø) determine the volume of vapor displaced outwardly from said tubular portion when said container having a liquid at a preselected level therein is tilted for drinking to an angle theta (Ø) wherein liquid is available at said liquid outlet, and wherein said shape of said lower end portion is provided to minimize differences between a first volume of vapor displaced when said container has a preselected first liquid level, and a second volume of vapor displaced when said container has a preselected second liquid level therein;

(c) wherein said at least one first vapor passageway comprises a port through said lid positioned for vapor communication between said tubular portion of said baffle assembly and ambient air, and wherein said at least one second vapor passageway comprises a port through said lid positioned for vapor communication between ambient air and a ullage space within said bowl of said container external to said tubular portion of said tubular baffle assembly.

45. The combination as set forth in claim 44, wherein said tubular baffle assembly is sealingly affixed to said inner surface portion of said lid.

46. The combination as set forth in claim 44, wherein said tubular baffle assembly and said lid comprise an integral, one-piece molded component.

47. The combination as set forth in claim 44, wherein said tubular baffle assembly further comprises a partial-pipe element, said partial-pipe element running longitudinally along at least a portion of said tubular portion of said tubular baffle assembly and oriented toward said liquid outlet in said lid, so as to form a liquid accepting indentation in said at least a portion of said tubular portion of said tubular baffle assembly.

48. A method of directing an aroma emanating from a liquid to the nose of a consumer of the liquid, said method comprising:

(a) providing a container comprising an opening and a bowl portion, said bowl portion adapted for containing said liquid therein;

(b) providing a lid releasably and substantially sealably positionable on said container overlying said opening, said lid having an inner surface portion, said lid further comprising (i) a liquid outlet, (ii) at least one first vapor passageway, (iii) at least one second vapor passageway, (iv) a tubular baffle assembly, said tubular baffle assembly having an upper end portion sealingly secured to and depending from said inner surface portion of said lid and a tubular portion extending downwardly for a preselected distance into said bowl portion of said container to a lower end portion having an opening, said tubular portion having a transverse area, and wherein said lower end portion, said preselected length, and said transverse area define a maximum vapor capture volume in said tubular portion, and wherein said transverse area and a tilt angle theta (ø) determine the volume of vapor displaced outwardly from said tubular portion when said container having a liquid at a preselected level therein is tilted for drinking to an angle theta (ø) wherein liquid is available at said liquid outlet, and wherein said shape of said lower end portion is provided to minimize differences between a first volume of vapor displaced when said container has a preselected first liquid level, and a second volume of vapor displaced when said container has a preselected second liquid level therein;

(c) wherein said at least one first vapor passageway comprises a port through said lid positioned for vapor communication between said tubular portion of said baffle assembly and ambient air, and wherein said at least one second vapor passageway comprises a port through said lid positioned for vapor communication between ambient air and a ullage space within said bowl of said container external to said tubular portion of said tubular baffle assembly.

(d) tilting said container from the vertical by an angle theta (ø) to urge liquid toward said liquid outlet, and to displace vapor contained in said tubular portion out through at least one said first vapor passageways, (e) whereby said aromoa is directed to said nose of said consumer of said liquid.

49. A beverage container lid for use with a liquid container having an upwardly directed opening and a bowl portion adapted for containing a liquid therein, said lid comprising:

(a) a lid base, said lid base releasably and sealably positionable on a container while overlying said opening, said lid having an inner surface portion, said lid further comprising (i) a liquid outlet, (ii) at least one first vapor passageway, (iii) at least one second vapor passageway, (iv) a baffle assembly, said baffle assembly having an upper end portion sealingly secured to and depending from said inner surface portion of said lid and a downward portion extending for a preselected distance into said bowl portion of the container to a lower end portion, said baffle assembly comprising a central baffle, a main baffle mounted transverse to said central baffle, and a generally U-shaped partial-pipe baffle affixed at a distal end of said central baffle;

(b) wherein said at least one first vapor passageway comprises a port through said lid positioned for vapor communication between said one side of said baffle assembly and ambient air, and wherein said at least one second vapor passageway comprises a port through said lid positioned for vapor communication between ambient air and a ullage space within the bowl of the container to the second chamber.

50. The combination as set forth in claim 49, wherein said tubular baffle assembly is sealingly affixed to said inner surface portion of said lid.

51. The combination as set forth in claim 49, wherein said tubular baffle assembly and said lid base comprise an integral, one-piece molded beverage container lid.

* * * * *